United States Patent [19]

Fujita

[11] 4,160,438

[45] Jul. 10, 1979

[54] PROFILING APPARATUS FOR A DISK-LIKE ARTICLE HAVING A CYLINDRICAL FACE AND ROUNDED CORNERS

[75] Inventor: Michio Fujita, Nagoya, Japan

[73] Assignee: Toyoda-Koki Kabushiki-Kaisha, Aichi, Japan

[21] Appl. No.: 878,888

[22] Filed: Feb. 17, 1978

[30] Foreign Application Priority Data

Feb. 17, 1977 [JP] Japan ..... 52/18904[U]

[51] Int. Cl.[2] ..... B24B 53/06

[52] U.S. Cl. ..... 125/11 TP

[58] Field of Search ..... 125/11 CD, 11 TP, 11 PH, 125/11 R, 11 CC; 51/127

[56] References Cited

U.S. PATENT DOCUMENTS 2,659,359 11/1953 Hill ..... 125/11 PH
3,121,423 2/1964 Price ..... 125/11

FOREIGN PATENT DOCUMENTS 51-33028 5/1976 Japan ..... 125/11 TP
806629 12/1958 United Kingdom ..... 125/11 PA

*Primary Examiner*—Harold D. Whitehead
*Attorney, Agent, or Firm*—Oblon, Fisher, Spivak, McClelland & Maier

[57] ABSTRACT

A profile dressing apparatus for a grinding wheel wherein a dressing tool is moved, in radial and axial directions of the wheel, together with a non-extensible stylus tracing a full form template so as to form a cylindrical face and rounded corners on the wheel. First and second extensible styluses are provided for selective contact with first and second assistant templates when the non-extensible stylus ascends rounded corners formed on the full form template. The assistant templates respectively present outwardly downward gentle slopes from the rounded corners of the full form template, so that the non-extensible stylus can easily ascend each of the rounded corners.

8 Claims, 3 Drawing Figures

PROFILING APPARATUS FOR A DISK-LIKE ARTICLE HAVING A CYLINDRICAL FACE AND ROUNDED CORNERS

BACKGROUND OF THE INVENTION

1. Field of the Invention

The present invention relates to an apparatus for profiling an article such as a grinding wheel, having a cylindrical face and rounded corners joining both ends thereof, in template tracing manner.

2. Brief Description of the Prior Art

Conventionally, a grinding wheel for grinding pins of a crankshaft is dressed, in template tracing manner, to have a cylindrical face and rounded corners joining both ends thereof. In such dressing, a stylus is moved to trace a template which is formed with a straight portion and rounded corners, joining both ends thereof, so as to correspond to the profile of the grinding wheel and further, with steep slopes joining the rounded corners. However, excessive load is exerted upon the template and the stylus when the same ascends each steep slope, and this makes smooth and precise tracing of the stylus difficult.

For this reason, an attempt has heretofore been made to cause the stylus to trace the template upon movement only in a direction descending the steep slope of the template. In a known dressing device which embodied such an attempt effect, the stylus, when moved in an ascending direction, is first withdrawn to a little lower position than the height of the straight portion of the template prior to traverse movement and is then traversed toward and along the straight portion of the template. However, the stylus impacts upon a point on each rounded corner in the vicinity of the straight portion when coming into contact therewith. This not only causes a dressing tool to bite the grinding wheel, but also accelerates partial wear of the stylus and the template, thus resulting in deterioration of machining accuracy.

Another type of improved dressing devices has also been known which uses two templates one for dressing process from one side to the other side and the other for dressing process from the other side to one side. Two styluses are provided therein for selective contact with the corresponding templates. Even if two templates and two styluses can be made with the same precision, however, there is effected different wear characteristic between the templates as well as between the styluses. Thus, the dressing process from one side to the other side substantially differs in dressing condition from the dressing process from the other side to the one side, so that the dressing accuracy of the grinding wheel cannot be maintained so as to be uniform and stable.

SUMMARY OF THE INVENTION

Accordingly, it is a primary object of the present invention to provide an improved profiling apparatus capable of precisely forming a cylindrical face and rounded corners joining both ends thereof on a disc-like article such as, preferably, a grinding wheel.

Another object of the invention is to provide an improved profiling apparatus of the character set forth above which employs a full form template and two assistant templates.

Still another object of the invention is to provide an improved profiling apparatus of the character set forth above wherein a non-extensible stylus traces a full form template to profile a disc-like article, but two extensible styluses respectively trace assistant templates to facilitate the ascent of the corresponding rounded corner by the non-extensible stylus.

A further object of the invention is to provide an improved profiling apparatus of the character set forth above wherein each of extensible styluses, when tracing the corresponding assistant template, acts to compulsorily withdraw a non-extensible stylus from contact engagement with a full form template.

Briefly, according to the present invention, there is provided a profiling apparatus which comprises a traverse slide slidable for movement in parallel relation with a cylindrical face of a disc-like article rotatably carried, a cross slide slidably mounted on the traverse slide for movement transversal to the sliding direction of the traverse slide, a traverse feed member for reciprocatively moving the traverse slide, a profiling tool supported on the cross slide, a full form template fixedly disposed and having a straigth portion and rounded corners joining both ends thereof, a non-extensible stylus fixed to cross slide, a mechanism for urging the cross slide to maintain contact between the non-extensible stylus and the full form template, first and second assistant templates fixedly disposed, an extensible stylus member extensibly provided on the cross slide for contact engagement with the first and second assistant templates, and a stylus actuation mechanism for moving the stylus member.

The stylus actuation mechanism is operable to extend the stylus member into contact with the first assistant template when the non-extensible stylus ascends one of the rounded corners of the full form template and with the second assistant template when the non-extensible stylus ascends the other rounded corner of the full form template. Further, the first and second assistant templates respectively present outwardly downward gentle slopes from the rounded corners of the full form template, so that the ascents of the rounded corners by the non-extensible stylus can be facilitated.

BRIEF DESCRIPTION OF THE DRAWINGS

Various other objects, features and attendant advantages of the present invention will be readily appreciated as the same becomes better understood by reference to the following detailed description of a preferred embodiment when considered in connection with the accompanying drawings, wherein like reference numerals designate like or corresponding parts throughout the several views, and in which.

DETAILED DESCRIPTION OF A PREFERRED EMBODIMENT

Figure 1:
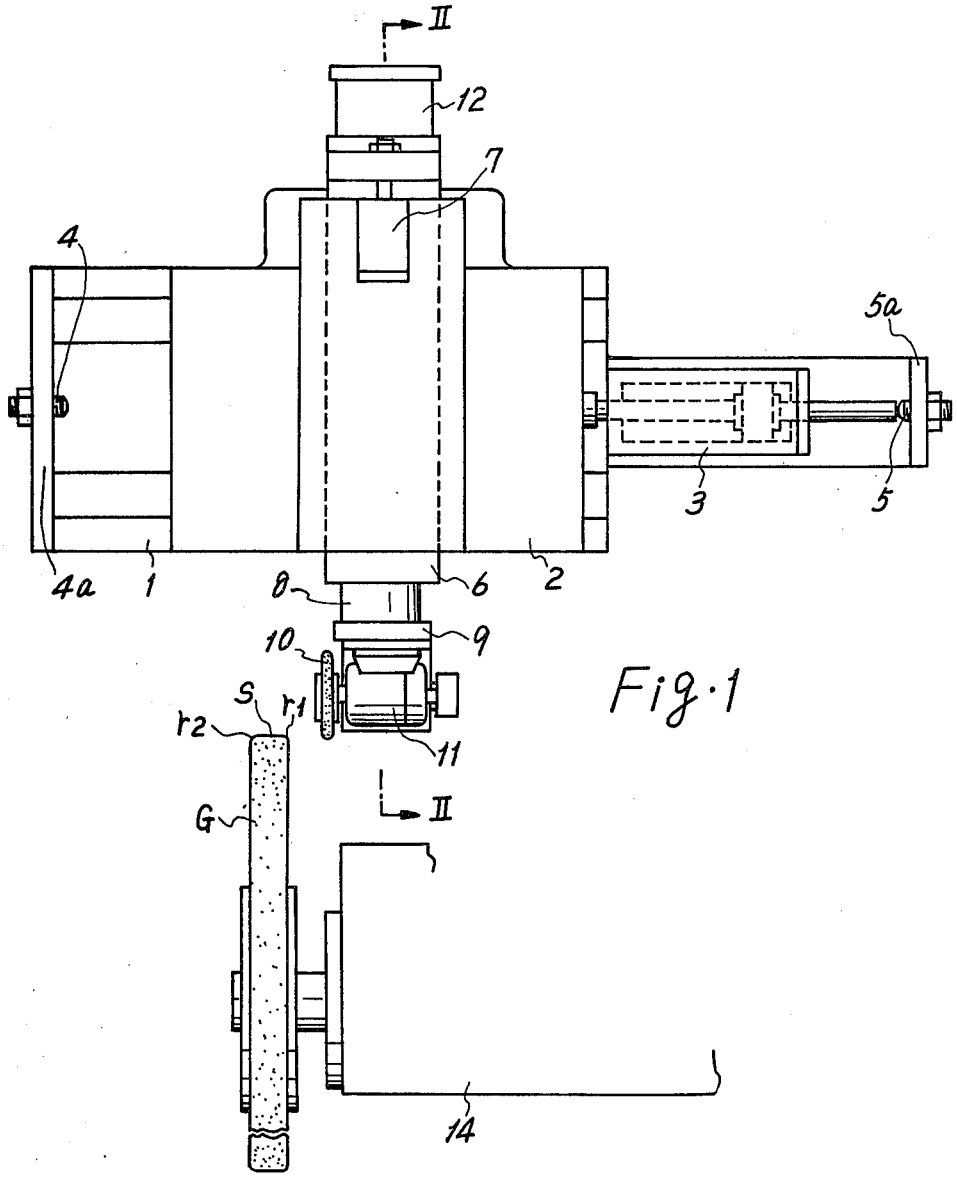
FIG. 1 is a plan view of a profiling apparatus according to the present invention.
Figure 2:
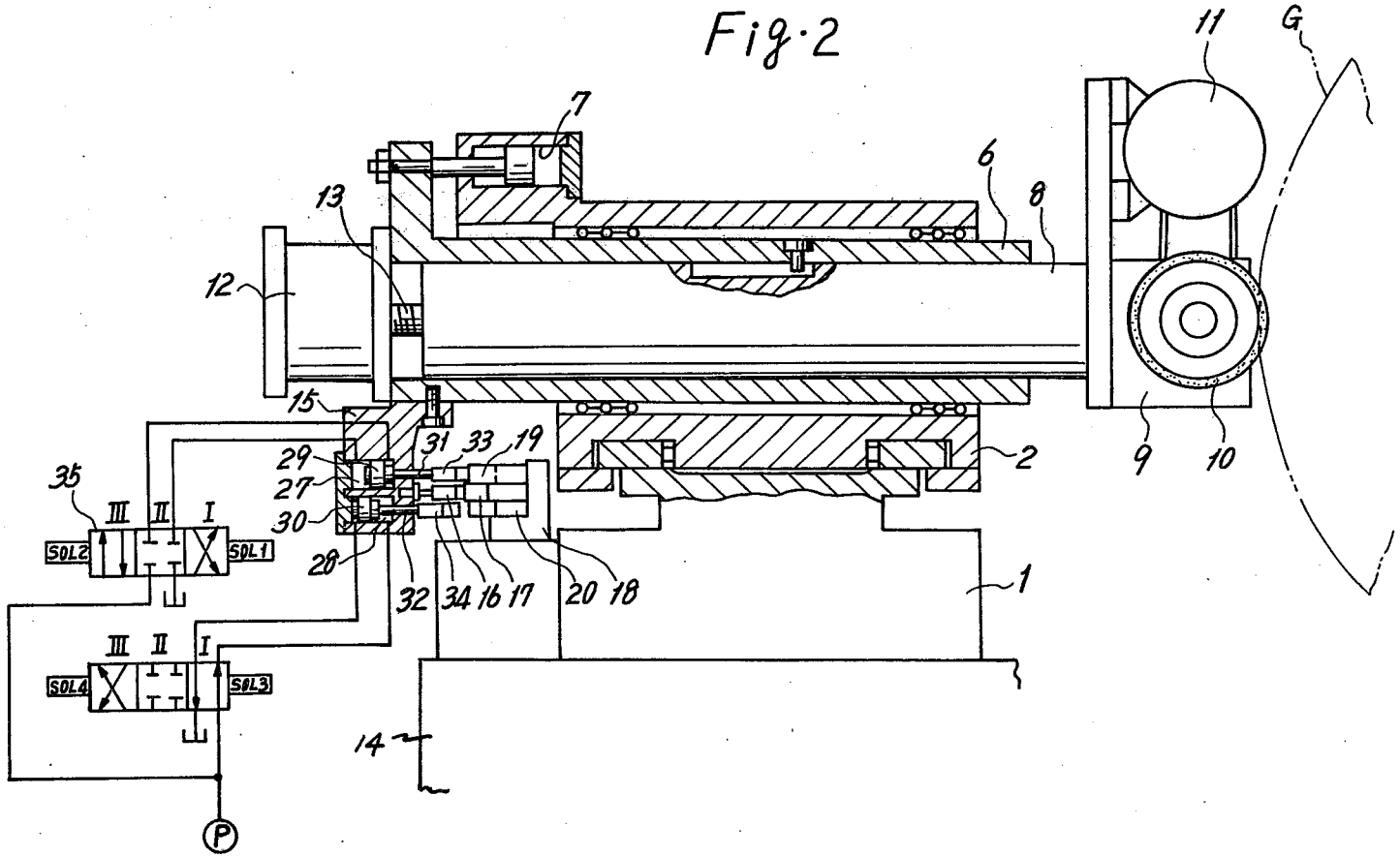
FIG. 2 is an enlarged partial sectional view of the apparatus taken along the line II—II of FIG. 1.
Figure 3:
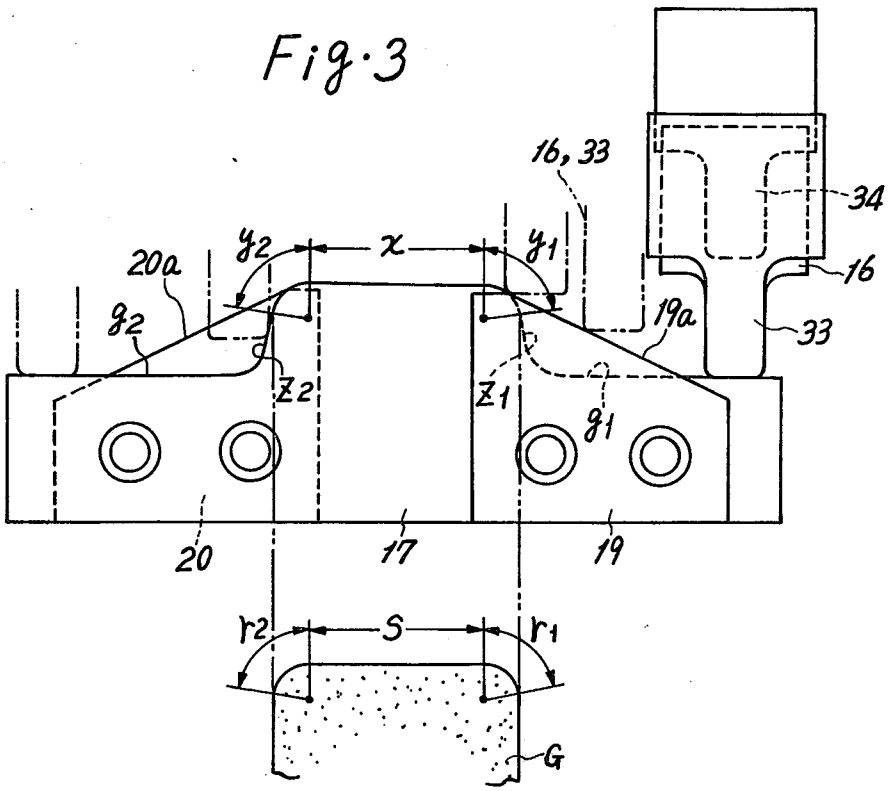
FIG. 3 is an enlarged plan view illustrating templates in connection with a dressed grinding wheel.

Referring now to the drawings, and more particularly to FIGS. 1 and 2 thereof, a base 1 of a profile dressing apparatus is shown mounted on a bed or a wheel head 14 of a grinding machine. A traverse slide 2 is slidably mounted on the base 1 for movement in parallel relation with the axis of a disk-like article, that is a grinding wheel G rotatably carried on a wheel head 14 and is moved by a traverse cylinder 3 mounted on the base 1. The wheel G is for grinding pins of a crankshaft and is formed with a straight or cylindrical face S and rounded corners r1 and r2 respectively joining both ends thereof, as best shown in FIG. 3. Stop screws 4 and 5 are provided for adjustably restricting traverse advanced and retracted positions of the traverse slide 2 and are in threaded engagement with support brackets 4*a* and 5*a* fixed on the base 1, respectively.

A cross slide 6 is slidably received in the traverse slide 2 for movement transversal to the sliding direction of the traverse slide 2 and is moved by an urging cylinder 7 provided on the top of the traverse slide 2. A tool support ram 8 is received within the cross slide 6 to be slidable only in the same direction as the sliding movement as the cross slide 6. Fixedly mounted on the front end of the ram 8 is a tool support 9, on which a dressing tool 10, consisting of a diamond roll for dressing the wheel G, is in turn rotatably carried for rotation about an axis parallel with the wheel axis. A motor 11 is mounted also on the tool support 9 and is in driving connection with the dressing tool 10. An infeed device 12, fixedly mounted on the rear end of the cross slide 6, is connected to the rear end of the ram 8 through a feed screw 13 so as to intermittently impart an infeed to the dressing tool 10.

Further, the cross slide 6 has fixed on its under portion a support block 15, to which a non-extensible stylus 16 is secured for contact with a full form template 17 having a predetermined profile. As best shown in FIG. 3, the template 17 is formed with a straight portion x and rounded corners y1 and y2 respectively joining both ends thereof in correspondence to the cross section of the grinding wheel G and is further formed with steep slopes z1 and z2, which are joined to the rounded corners y1 and y2 at the ascended ends thereof and to straight guide portions g1 and g2 at the descended ends thereof, respectively. At the rear portion of the base 1, there is fixedly provided a template support 18, to which the template 17 is secured together with first and second assistant templates 19 and 20, being sandwiched therebetween. The assistant templates 19 and 20 are disposed at both ends of the straight portion x and are formed with outwardly downward gentle slopes 19*a* and 20*a* tangentially joining the rounded corners y1 and y2 in the vicinity of the straight portion x, respectively.

The support block 15 is formed with stylus actuation cylinders 27 and 28 in parallel relation, into which pistons 29 and 30 are respectively fitted to be slidable in the same direction as the sliding movement of the cross slide 6. The pistons 29 and 30 have secured to ends of their piston rods 31 and 32 first and second extensible styluses 33 and 34, which are able to contact with the slopes 19*a* and 20*a* of the assistant templates 19 and 20, respectively. The tips of the extensible styluses 33 and 34 will be aligned with that of the non-extensible stylus 16 when the pistons 29 and 30 will be at their advanced positions. Change-over valves 35 and 36 are provided for controlling extension movements of the styluses 33 and 34 and are connected between the actuation cylinders 27 and 28 and a pressurized fluid supply P.

The operation of the apparatus as constructed above will hereinafter be described. When the urging cylinder 7 is first actuated, then the cross slide 6 is advanced toward the grinding wheel G so as to contact the stylus 16 with the straight guide portion g1 of the full form template 17. Simultaneously with this, the change-over valve is switched to the position I to advance the piston 29 to its advanced end and thereafter, to position II to block the cylinder 27, whereby the tip of the extensible stylus 33 is fixedly maintained aligned with the tip of the non-extensible stylus 16. In addition, the other change-over valve 36 is switched to the position I to retract the piston 30, by which the other extensible stylus 34 is thus retracted to a position where it does not contact with the assistant template 20.

With the advance operation of the traverse cylinder 3 in this condition, the traverse slide 2 is advanced from the original or retracted position toward the left as viewed in FIG. 1. The extensible stylus 33 ascends as it slides along the gentle slope 19*a* of the assistant template 29 and thus, makes the non-extensible stylus 16 distant from the full form template 17. When the extensible stylus 33 reaches the top of the gentle slope 19*a*, the non-extensible stylus 16 is caused to smoothly come into contact with the rounded corner y1 in the vicinity of the straight portion x of the full form template 17. Thereafter, the non-extensible stylus 16 is slid along the straight portion x and then, is descended along the other rounded corner y2, whereby the cylindrical face S and the rounded corner r2 of the grinding wheel G are dressed with the dressing tool 10 over the entire length thereof. Furthermore, the non-extensible stylus 16 is descended along the steep slope z2 of the template 17 and then, is slid along the straight guide portion g2. The movement of the traverse slide 2 is stopped at an advanced position where the slide 2 is brought into abutting engagement with the stop screw 4.

When the change-over valve 35 is subsequently switched to the position III, the extensible stylus 33 is withdrawn to a position where it no longer contacts with the assistant template 19. Furthermore, the change-over valve 36 is switched to the position III to advance the piston 30 to its advanced end and thereafter, to the position II to block the cylinder 28. The extensible stylus 34 is therefore fixedly maintained with its tip aligned with that of the non-extensible stylus 16. The traverse cylinder 3 is reversely actuated in this condition so as to retract the traverse slide 2. As a result, the extensible stylus 34 ascends as it slides on the gentle slope 20*a* of the assistant template 20 and thus, causes the non-extensible stylus 16 to be distant from the full form template 17.

Upon ascending by the extensible stylus 34 to the top, the non-extensible stylus 16 is caused to smoothly come into contact with the rounded corner y2 in the vicinity of the straight portion x of the template 17 and is upwardly moved along the rounded corner y2. In accordance with the reverse of the foregoing cycle, the non-extensible stylus 16 is slid along the straight portion x of the template 17 and then, is descended along the rounded corner y1, whereby the entire length of the rounded corner y1 of the grinding wheel G is also dressed with the dressing tool 10. The non-extensible stylus 16 is descended along the steep slope z1 of the full template 17 and then, is moved along the straight guide portion g1 thereof. Upon the arrival of the stylus 16 to the original position, the traverse slide 2 is brought into abutting engagement with the stop screw 5 through a piston rod of the cylinder 3 so as to be prevented from further retraction movement, whereby the dressing operation is completed.

Although the assistant templates 19 and 20 in the foregoing embodiment are disposed with the full form templates 17 sandwiched therebetween, it is to be noted that they may otherwise be disposed on one side of the full form template 17. In this case, an advantage can be obtained that there can be eliminated either one of the extensible styluses, for example, 34 and the cylinder 28 associated thereto. It is to be noted, however, that slight alteration in control is needed to withdraw the extensible stylus 33 in the way of transverse movement from the straight portion x toward each rounded corner y1, y2 so that the descent of each rounded corner y1, y2 by the non-extensible stylus 16 cannot be obstructed.

Although the present invention has been applied to a profile dressing apparatus in the foregoing embodiment, it may otherwise be applied also to a profile machining apparatus for machining, in template tracing manner, workpieces each of which has the same section as that of the grinding wheel G.

As mentioned previously, in a profiling apparatus according to the present invention, the assistant templates, which respectively present outwardly downward gentle slopes from both ends of the straight portion of the full form template, are provided on the base; the extensible styluses respectively facing the slopes of the assistant templates are provided on the cross slide for movements in the same direction as the sliding movement of the cross slide; and the cylinder devices for extending the extensible styluses into contact engagement with the slopes of the assistant templates are provided on the cross slide. In operation, the extensible styluses are slid along the slopes of the assistant templates so as to cause the non-extensible stylus to come into contact with the rounded corners in the vicinity of the straight portion of the full form template. Accordingly, the ascent of the rounded corners by the non-extensible stylus can be facilitated. This results in preventing partial wear of the non-extensible stylus as well as of the full form template, so that a highly accurate profiling process can be advantageously achieved.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An apparatus for forming a cylindrical face and rounded corners joining both ends thereof on a disc-like article rotatably carried, having a traverse slide for movement in parallel relation with said cylindrical face, a cross slide slidably mounted on said traverse slide for movement in a direction transversal to the movement of said traverse slide, traverse feed means for reciprocatively moving said traverse slide, a profiling tool carried on said cross slide, a full form template having a straight portion and rounded corners joining both ends thereof, a non-extensible stylus fixed to said cross slide, and means for urging said cross slide to maintain contact between said stylus and said template, the improvement comprising;

first and second assistant templates fixedly disposed and respectively presenting outwardly downward gentle slopes from said rounded corners of said full form template, extensible stylus means extensibly provided on said cross slide for contact engagement with said first and second assistant templates, and stylus actuation means for moving said extensible stylus means so as to bring the extensible stylus means into contact with said first assistant template when said non-extensible stylus ascends one of said rounded corners of said full form template and with said second assistant template when said non-extensible stylus ascends the other of said rounded corners of said full form template.

2. An apparatus as set forth in claim 1, wherein said disc-like article and said profiling tool respectively comprise a grinding wheel and a dressing tool for dressing the same.

3. An apparatus as set forth in claim 2, wherein said extensible stylus means includes first and second extensible styluses, and wherein said stylus actuation means is operable to extend the first extensible stylus into contact with said first assistant template upon movement of said traverse slide in one direction and to extend the second extensible stylus into contact with said second assistant template upon movement of said traverse slide in another direction.

4. An apparatus as set forth in claim 3, wherein each of said slopes of said first and second assistant templates is formed tangentially of the corresponding one of said rounded corners of said full form template.

5. An apparatus as set forth in claim 4, wherein each of said extensible styluses is extended by said stylus actuation means to a position where a tip of said each extensible stylus aligns with a tip of said non-extensible stylus.

6. An apparatus as set forth in claim 5, further comprising;

a tool support slidably mounted on said cross slide for movement in a radial direction of said grinding wheel and carrying said dressing tool thereon, and infeed means for intermittently infeeding said tool support toward said grinding wheel.

7. An apparatus as set forth in claim 6, wherein said dressing tool comprises a rotary dresser rotatably carried on said tool support for rotation about an axis parallel with the sliding direction of said traverse slide, and includes a motor mounted on said tool support for rotating said rotary dresser.

8. An apparatus as set forth in claim 7, wherein said first and second assistant templates are fixedly disposed with said full form template sandwiched therebetween.

* * * * *